United States Patent [19]

Imes

[11] Patent Number: 4,646,708

[45] Date of Patent: Mar. 3, 1987

[54] ARCHERY BOW

[76] Inventor: Clifford W. Imes, 7068 Tuckahoe Rd., Williamson, N.Y. 14589

[21] Appl. No.: 755,090

[22] Filed: Jul. 15, 1985

[51] Int. Cl.[4] ..... F41B 5/00

[52] U.S. Cl. ..... 124/24 R; 124/DIG. 1

[58] Field of Search ..... 124/23 R, 24 R, DIG. 1

[56] References Cited

U.S. PATENT DOCUMENTS 3,595,213 7/1971 Storer ..... 124/23 R 3,993,039 11/1976 Groves et al. ..... 124/23 R

*Primary Examiner*—Richard C. Pinkham

*Assistant Examiner*—Benjamin Layno

*Attorney, Agent, or Firm*—Samuel R. Genca

[57] ABSTRACT

An improved archery bow wherein draw force let off and continuous concurrent storing of energy is achieved by articulate bow limbs jointed at pivotal joints between energy storing resilient spring portions and shiftable bow tip-portions each having bow tips engaging the bowstring. The bow tips are shiftable about the pivotal joints through forward, neutral and rearward positions. Tendon cables coact with the bow tips resilient spring portions, and the bowstring for yieldingly spring biasing the bowstring and bow tips in the forward position and the bowstring in a rest position. The bowstring and tendon cables are coupled diametrically opposite each other at the bow tips so that forces acting through the tendon cables and the bowstring are resolved or split into force components. Some of these force components act through the bow tip-portions to the pivot joints during the shifting of the bow tips from the forward position to the rearward position to effect a draw force let off at the nocking point of the bowstring. Rollers are positioned in cooperative relationship with the spring portions of the bow limbs and the tendon cables to provide continuous transfer of energy to the spring portions of the bow limbs throughout the shifting of the bow tips from the forward position to the rearward position and movement of the bowstring from the rest position to a fully drawn position.

7 Claims, 8 Drawing Figures

FDC
FDL
FB
RDC
RDL
ΔDC

A-A

FORWARD DIRECTION
REARWARD DIRECTION
CD
BD

ARCHERY BOW

BACKGROUND OF THE INVENTION

1. Field of the Invention

The present invention relates to a compound archery bow for shooting an arrow and more particularly to an improved archery bow featuring draw force let off, distortion free bow tips and an highly effective and efficient archery bow.

2. Prior Art

Compound bows are well known to those skilled in the art. Such bows utilize eccentric cams, wheels and pulleys on the bow limb tips about which a bow string is sheaved such that when the bow string is drawn, the draw force on the bow string initially rapidly builds up to its maximum intended limit and thereafter noticeably falls off as the bow string is fully drawn. The advantage and purpose of such an operation are well known to those skilled in the art and such description and operation may be found in patent to Allen, U.S. Pat. No. 3,486,495; patent to Jenning, U.S. Pat. No. 4,241,715; patent to Roelle, U.S. Pat. No. 4,333,443 and patent to Simonds U.S. Pat. No. 4,438,756. While such prior art archery bows have worked satisfactorily and have improved and advanced the art, there still are pressing problems encountered with the use of eccentric cams, wheels and pulleys rotating on a shaft on the bow tips of the archery bow since the eccentric cams, wheels and pulleys add friction and inertia to the bow tip. The aforesaid prior art compound bows utilize forces which act along a line that does not pass through the center of rotation of the eccentric cams, wheels or pulleys to cause a moment about the center of rotation of the cams, wheels or pulleys. A moment about the eccentric cams, wheels or pulleys is equal to the force multiplied by the perpendicular distance from the line of action of the force to the center of rotation. In effect, clockwise moments about the center of rotation must be equal to the counter-clockwise moments for the bowstring to be in a state of equilibrium. While utilizing this basic principal in the aforesaid issued patents, a major problem is that the bowstring is sheaved on the cams, wheels and pulleys and provide such as eccentric loading on the bow tips and unduly high inertia on the bow tips of the archery bow. Further, such prior art also utilized cross cables which are generally proximal to the bowstring and interfere with an arrow being shot from the archery bow. Attempts have been made to configure the eccentric cams, wheels or pulleys with grooves which tend to place the bowstring in a non-interfering position relative to the cross cables. While these attempts place the bowstring in a non-interfering position, the added grooves for guarding the bowstring away from the cross cables do create another problem in that the bowstring must travel a greater distance over the grooves on the cams, wheels and pulleys to solve this problem.

Accordingly, there is a pressing need for a relatively simple, inexpensive, efficient improved archery bow which eliminates cams, wheels and pulleys and the aforesaid problems of eccentric loading, high inertia and friction in the bow tips and the utilization of moments about the axis of rotation at the bow tips in the clockwise and counter-clockwise directions.

SUMMARY OF THE INVENTION

In accordance with the present invention, there is provided an improved archery bow for propelling an arrow. The archery bow includes a handle for gripping the bow and first and second similar articulate resilient bow limbs connected to opposite ends of a handle and extending outwardly from said handle. The first articulate bow limb is jointed at a first pivotal joint between a first energy storing resilient spring portion and a first bow tip-portion. The second articulate bow limb is jointed at a second pivotal joint between a second energy storing resilient spring portion and a second bow tip-portion. The first and second bow tip-portions have first and second bow tips respectively shiftable through forward and rearward positions and a neutral position therebetween. The bow includes a bowstring connected between the first and second bow tips in. The bowstring is movable between a rest position and a drawn position and an intermediate position therebetween which positions correspond to the forward and rearward positions and neutral position of the bow tips respectively. The archery bow includes tendon means including a first tendon cable connected between the first bow tip and the second energy storing resilient spring portion and a second tendon cable connected between the second bow tip and the first energy storing resilient spring portion for yieldingly spring biasing the bow string and the first and second bow tips in the forward position and the bowstring in the rest position. The bowstring is disposed in the rest position under tension derived from the first and second spring portions of the bow limbs. The bowstring has a nocking point for applying a rearwardly acting draw force thereto of an increasing magnitude to shift the first and second bow tips from the forward position to the neutral position and a decreasing magnitude to shift the first and second bow tips from the neutral position to the rearward position with a corresponding movement of the nocking point of the bowstring from the rest position to the intermediate position and from the intermediate position to the drawn position. The bowstring and tendon cables are coupled diametrically opposite each other on the bow tips so that forces acting through the tendon cables and the bowstring are resolved or split into force components some of which force components are directed through the bow tip-portions to the pivot joints of the bow limbs during the shifting of the bow tips from the forward position to the rearward position to effect a draw force let off at the nocking point of the bowstring. Roller2 means positioned in cooperative relationship with the spring portions of the bow limbs and the tendon cables provide for the continuous transfer of energy from the bowstring to the energy storing spring portions of the bow limbs throughout the shifting of the bow tips from the forward position to the rearward position.

BRIEF DESCRIPTION OF THE DRAWING

The invention will be described in detail hereinafter with reference to the accompanying drawing which shows an improved archery bow in accordance with a preferred embodiment of the invention in which.

DESCRIPTION OF THE PREFERRED EMBODIMENT

Figures 1, 2:
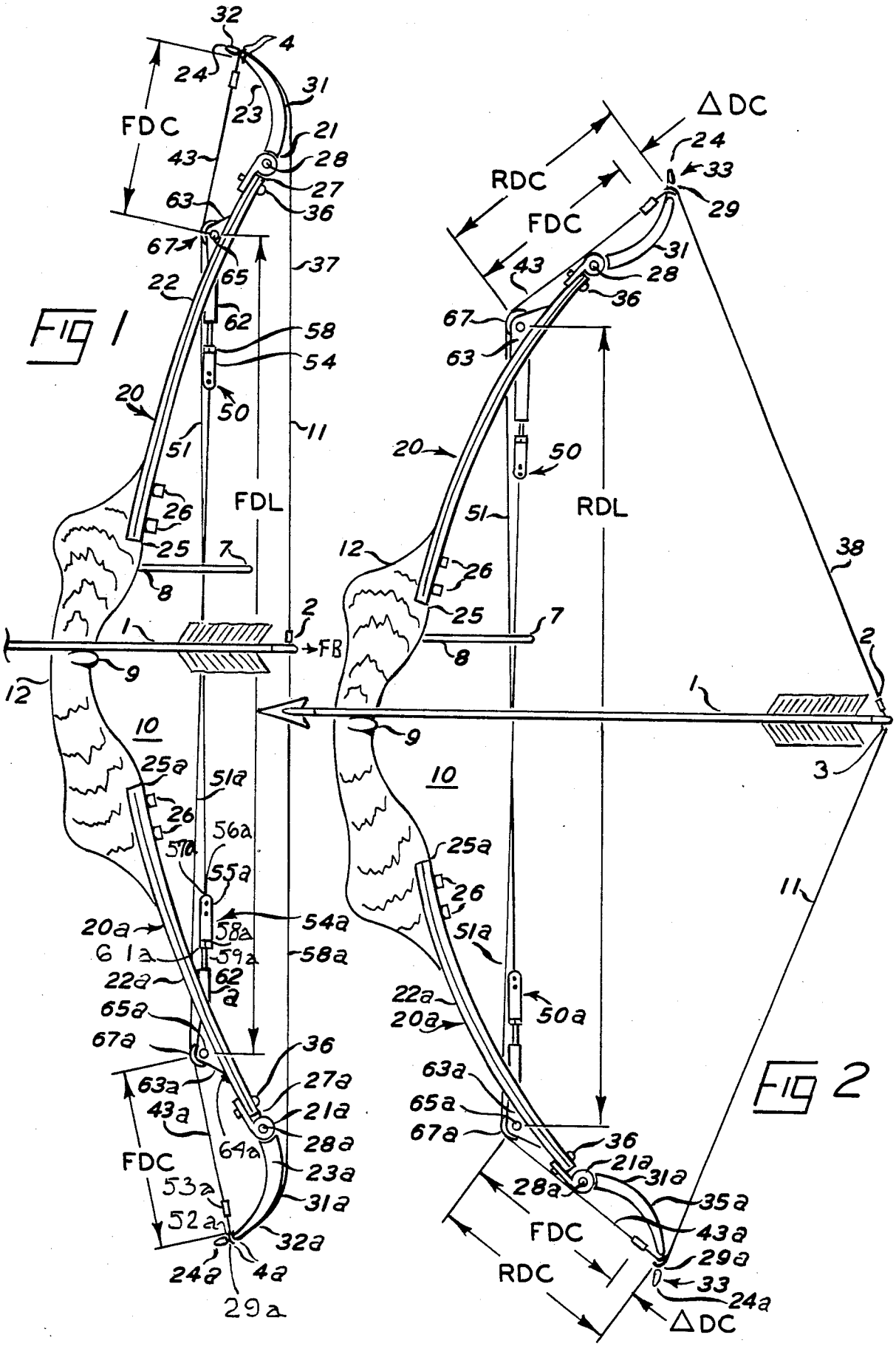
FIG. 1 is a side elevation of an improved archery bow according to the present invention with a bowstring in the rest position.
FIG. 2 is a side elevation of the improved archery bow with a bowstring in the drawn position.
Figures 3, 4, 5, 6:
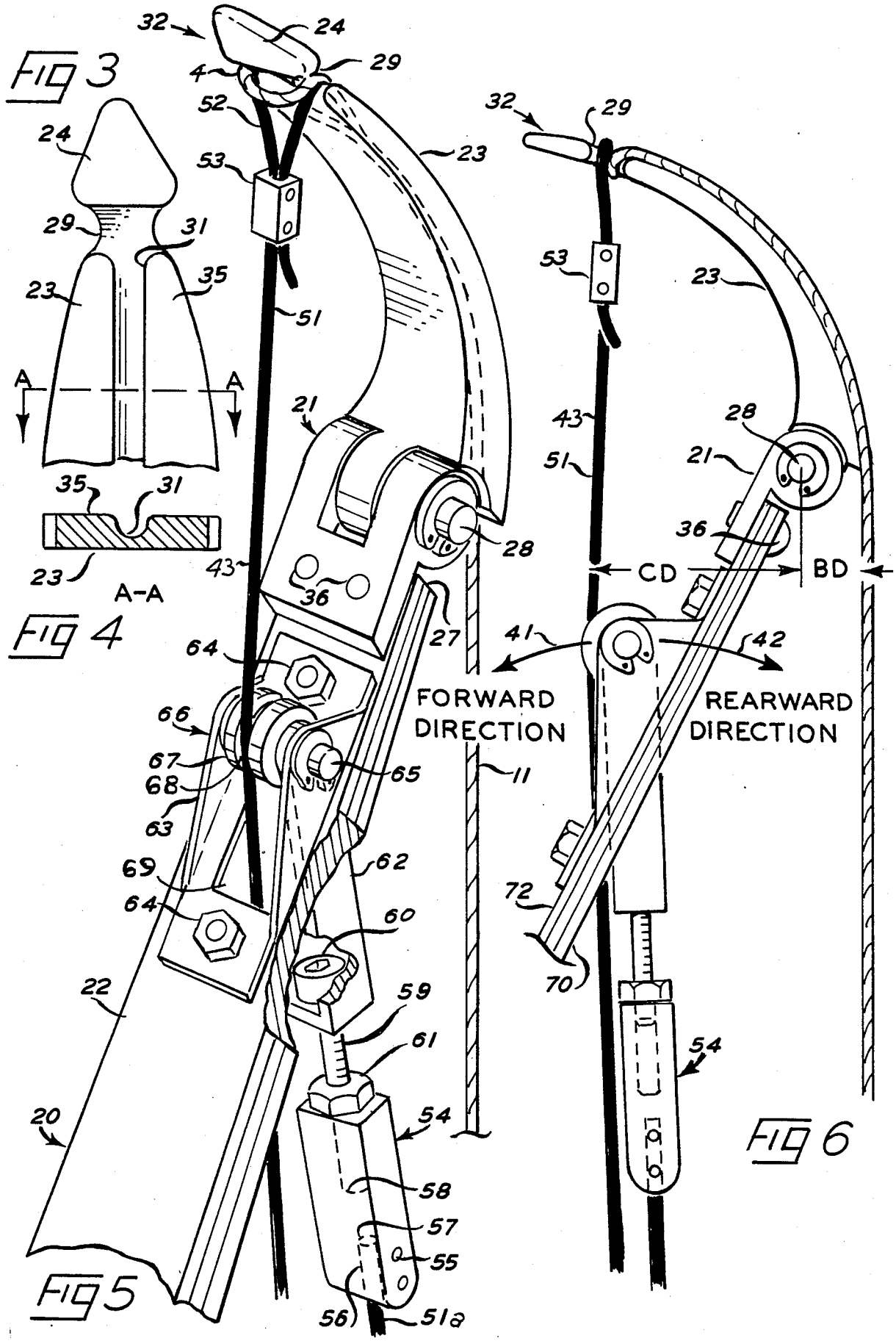
FIG. 3 is a fragmentary rear view of one of the bow tip-portions of the improved archery bow of FIG. 1.
FIG. 4 is a sectional view of the bow tip-portion shown in FIG. 3 taken along line A—A.
FIG. 5 is a fragmentary perspective view and the improved archery bow of FIG. 1.
FIG. 6 is an enlarged fragmentary elevation of part of the improved archery bow.

The archery bow 10 of the present invention will be described with particular reference to the preferred embodiment of the invention illustrated in the drawing. It should be understood that the drawing illustrations and description are to be taken only as illustrative of the preferred embodiment of the invention in the archery bow 10 and are to be understood in a general way and not in a restrictive way.

Referring to FIGS. 1–7 inclusive of the drawing, the archery bow 10 in accordance with the preferred embodiment of the invention is shown with an arrow 1 (FIGS. 1, 2). The archery bow 10 includes a bowstring 11, a handle 12 for gripping the archery bow 10 and first and second similar articulate resilient bow limbs 20, 20*a*, respectively, extending outwardly from the handle 12. The first and second articulate bow limbs 20 and 20*a* respectively are similar to each other and accordingly like elements will have the same numerical designations except that the second bow limb 20*a* will have the small letter "a" after the numerical designation to show that the particular element is part of the second articulate limb 20*a*.

The first articulate bow limb 20 is jointed at a first pivotal joint 21 disposed between a first energy storing resilient spring portion 22 and a first bow tip-portion 23 having a first bow tip 24. The first energy storing spring portion 22 is fixed at one end 25 to the handle 12 by bolts 26. The other end 27 of the first resilient spring portion 22 is connected to the first pivotal joint 21 by rivets 36. The first resilient spring portion 22 is arcuate and flexes in the forward direction 41 and rearward direction 42 with respect to the handle 12. The first bow tip-portion 23 is connected to the first pivotal joint 21 by a pivot pin 28 so that the first bow tip 24 pivots on pin 28 and is shiftable into a forward position 32 and a rearward position 33 and neutral position 34 therebetween. The first bow tip-portion 23 includes a notch 29 (FIG. 3) for fastening the bow string 11 to the first bow tip 24. A groove 31 is disposed along the rear side 35 of the first bow tip-portion 23 for receiving the bow string 11 therein. The first bow tip-portion 23 is recurved with respect to the first spring portion 22 and together with the first resilient spring portion 22 has the appearance of a recurved bow (not shown) when viewed from all sides. The first bow tip-portion 23 is recurved such that the bowstring 11 is disposed a distance BD from the center of the pivot pin 28 to the bowstring 11 when the bowstring 11 is in the rest position 37 as shown in FIG. 1. The bowstring 11 is movable between the rest position 37, the fully drawn position 38 and intermediate position 39, which positions correspond to the position of the first bow tip 24, namely forward position 32, rearward position 33 and the neutral position 34 therebetween.

The second articulate bow limb 20*a* is jointed at a second pivotal joint 21*a* disposed between a second energy storing resilient spring portion 22*a* and a second bow tip-portion 23*a* having a second bow tip 24*a*. The second energy storing spring portion 22*a* is fixed at one end 25*a* to the handle 12 by bolts 26. The other end 27*a* of the second resilient spring portion 22*a* is connected to the second pivotal joint 21*a* by rivets 36. The second resilient spring portion 22*a* is arcuate and flexes in the forward direction 41 and rearward direction 42 with respect to the handle 12. The second bow tip-portion 23*a* is connected to the second pivotal joint 21*a* by a pivot pin 28*a* so that the bow tip 24*a* pivots on pin 28*a* and is shiftable in a forward position 32 and a rearward position 33 and neutral position 34 therebetween. The second bow tip-portion 23*a* includes a notch 29*a* for fastening the bow string 11 to the second bow tip 24*a*. A groove 31*a* is disposed along the rear side 35*a* of the second bow tip-portion 23*a* for receiving the bow string 11 therein. The second bow tip-portion 23*a* is recurved with respect to the second spring portion 22*a* and together with the second resilient spring portion 22*a* has the appearance of a recurved bow (not shown) when viewed from all sides. The second bow tip-portion 23*a* is recurved such that the bow string 11 is disposed the same distance BD from the center of the pivot pin 28*a* to the bowstring 11 when the bowstring 11 is in the rest position 37. The bowstring 11 is moved between the rest position 37, the fully drawn position 38 and intermediate position 39, which positions correspond to the position of the first and second bow tips 24, 25, namely forward position, rearward position and neutral position therebetween.

The archery bow 10 includes tendon means 50 for spring biasing the first and second bow tips 24, 24*a* in the forward position 32 and for spring biasing the bowstring 11 in the rest position 37. The tendon means 50 includes first and second tendon cables 51 and 51*a* respectively. The first tendon cable 51 is coupled to the first bow tip 24 at the notch 29 of the first bow tip-portion 23 by a cable loop 52 of the first tendon cable 51. The cable loop 52 is secured by a cable clamp 53. The first tendon cable 51 is disposed diametrically opposite to the bowstring 11 in the notch 29 at the first bow tip 24. The bowstring 11 is disposed rearwardly of the first bow tip portion 23 while the first tendon cable 51 is disposed forwardly of the first bow tip-portion 23 so that depending upon the forces acting through the bowstring 11 and the first tendon cable 51, the first bow tip 24 is shifted about the pivot pin 28 into the forward position 32, the rearward position 33 or the neutral position 34 in accordance with the invention.

The first tendon cable 51 is connected to the second energy storing resilient spring portion 22*a* through an adjustable coupling means 54*a*. The adjustable coupling means 54*a* includes a threaded clamp bar 55*a* having a bore 56*a* for receiving one end 57*a* of the first tendon cable 51. The threaded clamp bar 55*a* includes a threaded hole 58*a* to receive an adjusting bolt 59*a*. A lock nut 61*a* locks the adjusting bolt 59*a* to the threaded clamp bar 55*a*. A yoke member 62*a* is coupled between the adjusting bolt 59*a* and to a bracket 63*a* fixed to the second energy storing resilient spring portion 22*a* of the second bow limb 20*a* proximal to the end 27*a* of the second spring portion 22*a*. The bracket 63*a* is fixed to the second resilient spring portion 22*a* by fasteners 64*a*. The yoke member 62*a* is hingedly connected to the bracket 63*a* by a hinge pin 65*a*. The second tendon cable 51*a* is coupled to the second bow tip 24*a* at the notch 29*a* of the second bow tip-portion 23*a* by a cable loop 52*a* of the second tendon cable 51*a*. The cable loop 52*a* is secured by a cable clamp 53*a* (FIG.1). The second tendon cable 51*a* is disposed diametrically opposite to the bowstring 11 in the notch 29*a* at the second bow tip 24*a*. The bowstring 11 is disposed rearwardly of the second bow tip-portion 23*a* while the second tendon cable 51*a* is disposed forwardly of the second bow tip portion 23*a* so that depending upon the forces acting through the bowstring 11 and the second tendon cable 51*a*, the second bow tip 24*a* is shifted about the pivot pin 28*a* into the forward position 32, the rearward position 33 or the neutral position 34 in accordance with the invention.

The second tendon cable 51*a* is connected to the first energy storing resilient spring portion 22 through an adjustable coupling means 54. The adjustable coupling means 54 includes a threaded clamp bar 55 having a bore 56 for receiving one end 57 of the second tendon cable 51*a*. The threaded clamp bar 55 includes a threaded hole 58 to receive an adjusting bolt 59. A lock nut 61 locks the adjusting bolt 59 to the threaded clamp bar 55. A yoke member 62 is coupled between the adjusting bolt 59 and to a bracket 63 fixed to the first energy storing resilient spring portion 22 of the first bow limb 20 proximal to the end 27 of the first spring portion 22. The cable 51 extends through an opening 69 in the bracket 63. The bracket 63 is fixed to the first resilient spring portion 22 by fasteners 64. The yoke member 62 is hingedly connected to the bracket 63 by a hinge pin 65. The adjusting bolt 59 has a head 60.

The archery bow 10 includes a roller means 66 including rollers 67, 67*a* rotatably mounted on the hinge pins 65, 65*a* in the brackets 63, 63*a* respectively. The rollers 67, 67*a* are positioned in cooperative relationship with the bow tips 24, 24*a* and the tendon cables 51, 51*a* respectively for spring biasing the first and second bow tips 24, 24*a* and for a continuous take-up of the first and second tendon cables 51, 51*a* and corresponding bending of the first and second spring portions 22, 22*a* as the first and second bow tips 24, 24*a* are shifted in the forward and rearward positions 32, 33 and the neutral position 34 therebetween. The rollers 67, 67*a* include a guide groove 68, 68*a* for guiding the tendon cables 51, 51*a* diametrically opposed to the bowstring 11.

The rollers 67, 67*a* have a separation distance FDL when the first and second bow tips 24, 24*a* are disposed in a forward position 32 and the bowstring 11 is disposed in the rest position 37. The first bow tip 24 is separated from the roller 67 by a separation distance FDC when the first bow tip 24 is disposed in the forward position 32. A tendon cable part 43 is disposed between the roller 67 and the first bow tip 24. In a like manner the second bow tip 24*a* is separated from the roller 67*a* by a separation distance FDC when the second bow tip 24*a* is disposed in a forward position 32. A tendon cable part 43*a* of the tendon cable 51*a* is disposed between the second bow tip 24*a* and the roller 67*a*. (FIG. 1). When the first bow tip 24 is shifted into the rearward position 33 the tendon cable part 43 of the tendon cable 51 is increased in length to a distance RDC; thus the tendon cable part 43 of the tendon cable 51 is increased in length between the roller 67 and the first bow tip 24 by a distance ΔDC. In a similar manner the tendon cable part 43*a* is disposed between the second bow tip 24*a* and the second roller 67*a* and has a separation distance RDC when the second bow tip 24*a* is shifted to the rearward position 33. Since the first and second tendon cables 51, 51*a* are of the same given fixed length, the resilient spring portions 22, 22*a* of the first and second bow limbs 20, 20*a* are each flexed at the first and second rollers 67, 67*a* by the change in length of the cable parts 43, 43*a* namely ΔDC. The flexing of the first and second bow limbs 20, 20*a* may be understood by viewing the change in distances between the first bow tip 24 and the first roller 67 and the second bow tip 24*a* and the second roller 67*a* and the separation distance between the first and second rollers 67, 67*a* as may be seen in FIGS. 1 and 2. When the first and second bow tips 24, 24*a* are in a forward position 32 the algebraic length of the tendon cables 51, 51*a* as measured between the first bow tip 24 and the second bow tip 24*a* is (FDL+FDC+FDC). When the bow tips 24, 24*a* are disposed in the forward direction 32 and the separation distance between the first and second rollers 67, 67*a* is a separation distance FDL. Since the algebraic length of the tendon cables 51, 51*a* does not change even when the bow tips 24, 24*a* change from the forward position 32 to the rearward position 33, the first and second resilient spring portions 22, 22*a* are forced to bend or deflect by the change in that tendon cable parts 43, 43*a* of the tendon cables 51, 51*a* by twice the distance ΔDC when the first and second bow tips 24, 24*a* are shifted to the rearward position 33. This may be seen by analysis of the change in distances expressed as follows:

Where RDL is the separation distance between rollers 67, 67*a* when the first and second bow tips 24, 24*a* are in the rearward direction 33;

RDC is the separation distance between the first bow tip 24 and the first roller 67, the separate distance between the second bow tip 24*a* and the second roller 67*a*;

FDL is the separation distance between the first and second rollers 67, 67*a* when the bow tips 24, 24*a* are disposed in the forward position 32;

FDC is equal to the separation distance between the first bow tip 24 and the first roller 67; and the separation distance between the second bow tip 24*a* and the second roller 67*a* when the first and second bow tips 24, 24*a* are disposed in the forward position 32;

ΔDC is the difference between the separation distances RDC and FDC (FIG. 2).

Accordingly:

$RDL+2(RDC)=FDL+2(FDC)$ [since cables 51, 51*a* are equal]

Where $RDC-FDC=\Delta DC$ $RDC=FDC+\Delta DC$ $RDL+2(FDC+\Delta DC)=FDL+2FDC$ [substituting for value of RDC]

$RDL+2FDC+2(\Delta DC)=FDL+2FDC$

Thus:

$FDL-RDL=2(\Delta DC)$

Thus, the change in the separation distance between the first and second rollers 67, 67*a* from FDL to RDL is the amount of flexure derived in the first and second energy storing resilient spring portions 22, 22*a* by the shift of bow tips 24, 24*a*.

The bowstring 11 includes a nocking point 2 at which point 2 the tail 3 of the arrow 1 engages the bowstring 11. The bowstring 11 includes loops 4 and 4*a* for connecting the bowstring between the first and second bow tips 24, 24*a*. The loops 4, 4*a* of the bowstring 11 are disposed in the grooves 29, 29*a* of the bow tips 24, 24*a* respectively. This arrangement provides a shifting or tipping of the bow tips 24, 24*a* about the pivotal joints 21, 21*a* in response to the forces acting through the first and second tendon cables 51, 51*a* and the bowstring 11 at loop 4, 4*a*.

In FIG. 1, the bowstring 11 is stressed in the rest position 37 by a spring bias force FC exerted by the first and second energy storing resilient spring portions 22, 22*a* acting through the first and second tendon cables 51, 51*a*. The first and second tendon cables 51, 51*a* are spaced a distance CD from their respective pivot joints 21, 21*a* to give a counter-clockwise movement equal to the clockwise movement of the bowstring 11 acting at the distance BD to effect a state of equilibrium about pivot joints 21, 21*a*.

The handle 12 includes an arrow shelf 9 for resting the arrow 1 thereon. Also included on the handle 12 is a cable guard 8 for keeping the cables 51, 51*a* slightly to the right of the arrow 1. The cable guard 8 has a rounded end 7. The cable guard 8 is of sufficient length to compensate for the bending of the first and second resilient spring portions 22, 22*a* of the first and second bow limbs 20, 20*a*.

Since the first and second rollers 67, 67*a* restrain the movement of the first and second tendon cables 51, 51*a*, there is only a small forward and rearward movement of the first and second cables 51, 51*a*.

OPERATION

Figure 7:
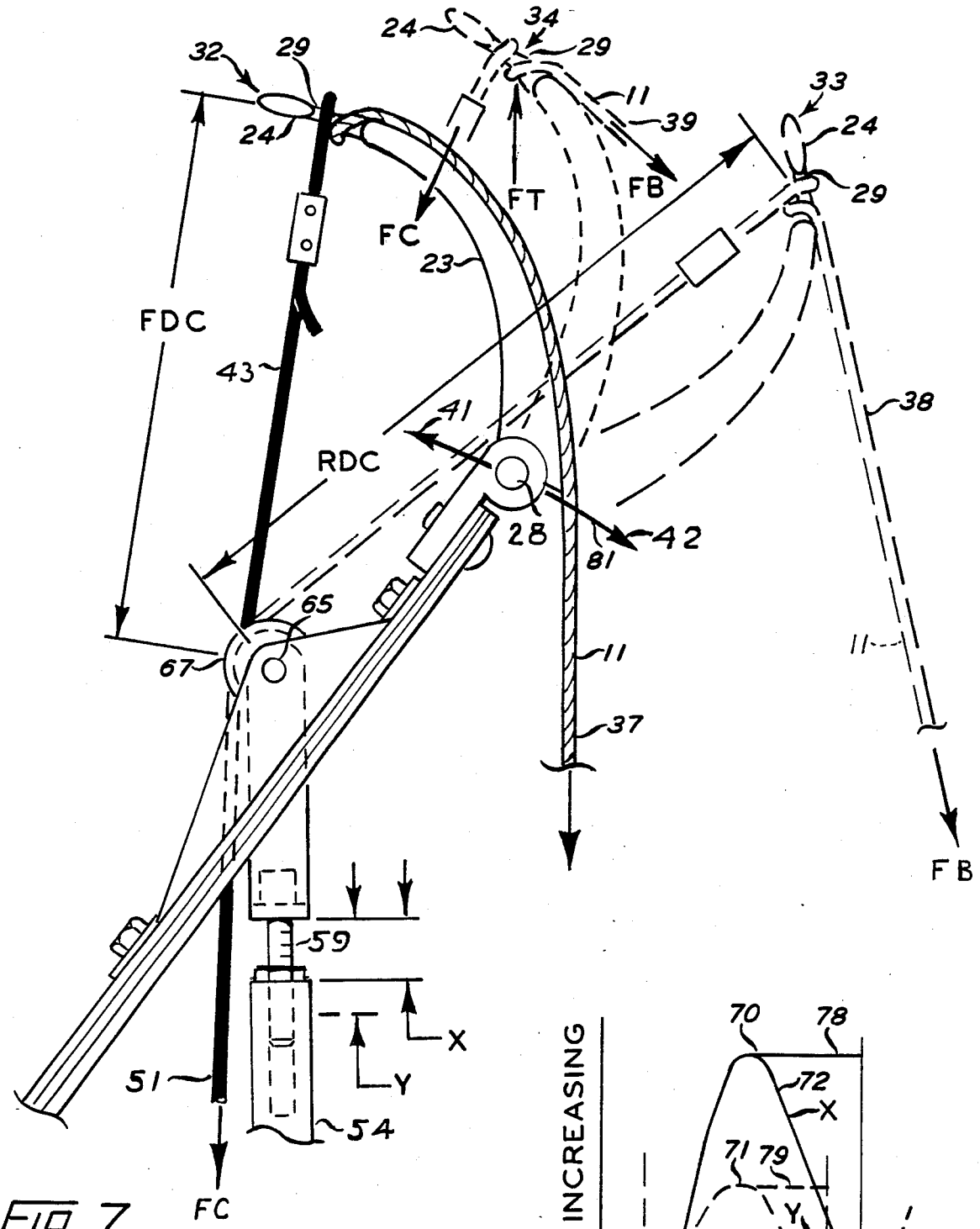
FIG. 7 is a side elevation of the improved archery bow showing a bow tip in the forward position, neutral position and rearward position.
Figure 8:
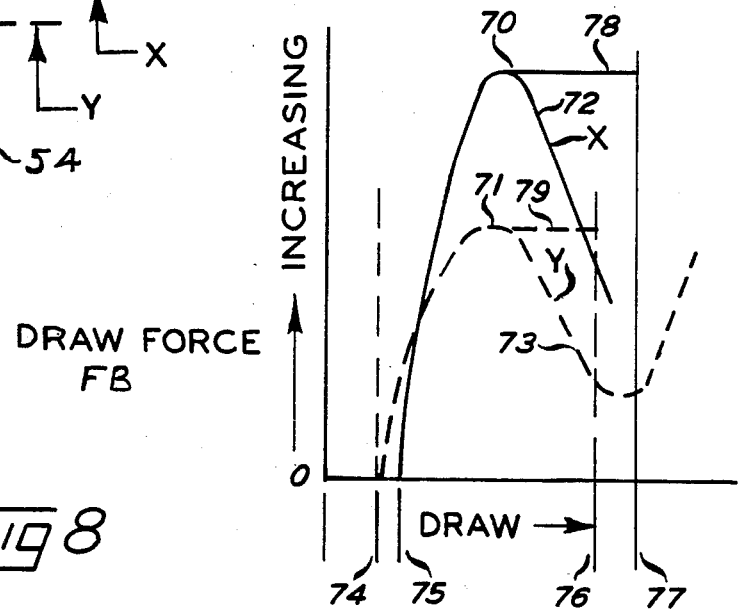
FIG. 8 is a draw force graph illustrating the operation of the improved archery bow.

The operation of the archery bow 10 will be described in conjunction with FIGS. 1 through 7 and FIG. 8. FIG. 8 is a two-axis graph to illustrate the work required to draw the bowstring 11 and the performance of the archery bow 10. The bowstring 11 displacement or length of draw is illustrated in FIGS. 1 and 2 of the drawing and is shown on a horizontal axis of the graph simply as DRAW. The draw length of the bowstring 11 is generally shown in a linear dimension such as inches; however, analog dimensions are not illustrated in the graph of FIG. 8. The vertical axis of the graph illustrates a draw force FB and is generally represented in pounds (not shown). Two draw force curves x, y are shown in the graph of FIG. 8. The draw force curve x of the graph shown in FIG. 8 will be used as a typical example for the operation of the archery bow 10. The archery bow 10 is adjusted or tuned by the adjusting bolts 59, 59*a*. In FIG. 7, the adjusting bolts 59, 59*a* are set at x to establish the separation distance FDL between the rollers 67, 67*a* (FIG. 1), when the bowstring 11 is in the rest position. Accordingly, the performance of the archery bow 10 will be described hereinafter in accordance with the draw force curve x shown in FIG. 8. The archery bow 10 has a draw length between a brace height illustrated by line 75 intersecting the horizontal axis DRAW and a line 77 intersecting the horizontal draw axis. The brace height is the height from the handle 12 to the bowstring 11 when it is disposed in the rest position 37 (FIG. 1). Line 77 in the graph represents the draw position 38 of the bowstring 11 (FIG. 2). Accordingly, the bowstring 11 displacement for the draw force curve x is between lines 75 and 77, which displacement may be expressed in inches or in length of the draw. The bowstring 11 is displaced by a draw force FB which is illustrated on the vertical axis which is named drawforce. As the bowstring 11 is drawn rearwardly by the rearwardly action draw force FB, the bowstring 11 is displaced from the rest position 37 rearwardly with an increase in the draw force FB to a draw force peak 70 on curve x. The draw force peak at 70 corresponds to the neutral position 34 of the bow tips 24, 24*a*. It should be noted that when the bow tips 24, 24*a* are disposed in the neutral position 23, the overall length of the archery bow 10 has substantially increased as a result of the draw force peak 70. As the bowstring 11 is further displaced, the draw force FB begins to decrease, resulting in a draw force let-off illustrated by a curve portion 72. With further displacement of the bowstring 11, and during the draw force let-off 72, the energy storing resilient spring portions 22, 22*a* are further deflected by the movement of the bow tips 24, 24*a* from the neutral position 34 to the rearward position 33, thereby continuing to store energy as shown by an energy curve portion 78 (FIG. 8). The first and second spring portions 22, 22*a* store potential energy as shown in the area under the draw force curve x and also under the energy curve portion 78.

In the operation of the archery bow 10, the bowstring 11 may be drawn from the rest position 37 (FIG. 1) to the drawn position (FIG. 2) and the intermediate position 39 which positions correspond to the forward position 32, the rearward position 33 and the neutral position 34 respectively (FIG. 7) taken by the bow tips 24, 24*a* in response to the drawing of bowstring 11.

The arrow 1 rests on the arrow shelf 9 of the handle 12 and engages the bowstring 11 at the nocking point by its tail 3 as is well known to those skilled in the art. The arrow 1 is shot from the bow 10 with kinetic energy that is a function of the potential energy stored by the first and second energy storing resilient spring portions 22, 22*a* of the first and second bow limbs 20, 20*a*. The efficiency of the bow 10 is a ratio between potential energy and kinetic energy and is expressed at a percentage. Potential energy in the archery bow 10 is derived from the draw force FB acting on the bowstring 11 at the nocking point 2.

Before the application of the draw force FB on the bowstring 11, the archery bow 10 is first viewed in the rest position 37 (FIGS. 1, 5, 6, 7). In the rest position 33, the bow tips 24, 24*a* are disposed in the forward position 32 in a state of equilibrium. The bowstring 11 is under tension and urges the bow tips 24, 24*a* in a clockwise direction about the pivot pins 28, 28*a* respectively while the tendon cables 51, 51*a* connected to the resilient spring portions 22, 22*a* of the bow limbs 20, 20*a* urge the bow tips 24, 24*a* in a counter-clockwise direction about the pivot pin 28 by a cable force FC to achieve the aforesaid state of equilibrium. As the rearwardly acting draw force FB increases in magnitude over the cable force FC, the bow tips 24, 24*a* are shifted clockwise about the pivot pin 28 towards the neutral position 34. At any instant of time, the forces acting on the bow tips 24, 24*a* namely the draw force FB, cable force FC and a force FT acting through the bow tip-portions 23, 23*a* may be resolved in a free body diagram in a state of equilibrium. Accordingly, the cable forces FC and draw force are split or resolved into force components (not shown) at the bow tips 24, 24*a*, some of which act through the bow tip-portions 23, 23*a*. As the draw force FB increases to the peak 70, the first and second bow tips 24, 24*a* are shifted into the neutral position 34. This increase in force is shown on the curve x in FIG. 8. During the shifting of the bow tips 24, 24*a* the tendon cables 51, 51*a* flex the first and second bow tip-portions 23, 23*a* to store potential energy therein.

When the bow tips 24, 24*a* start to shift from the neutral position 34 to the rearward position 33, a dynamic action takes place—the draw force FB to shift the bow tips 24, 24*a* to the rearward positions 33 now decreases as shown by the curve portion 72 of the curve x to the line 77 on the horizontal axis of the graph of FIG. 8. This is known as draw force let-off. The reason for this draw force let-off is that when the bow tip 24 is in the rearward position 33, the cable force FC acting through the cable 51 to urge the bow tip 24 to the neutral or rest positions 34, 34*a* is split or resolved into a force FT acting through the bow tip-portion 23 to the first pivotal joint 21 (FIG. 7).

During the shifting of the first and second bow tips 24, 24*a*, the tendon cables 51, 51*a* are pulled by the bowstring 11 in a continuous manner to flex the first and second resilient spring portions 22, 22*a* of the first and second bow limbs 20, 20*a* to store potential energy therein. During flexing of the first and second resilient spring portions 22, 22*a* the pivot pins 28, 28*a* move in an arc 81 (FIG. 7).

The potential energy stored in the first and second energy storing resilient spring portions 22, 22*a* is utilized when the bowstring 11 and arrow 1 are released from the drawn position 38. (FIG. 2). The flexed spring portions 22, 22*a* acting through the tendon cables 51, 51*a* urge the first and second bow tips 24, 24*a* to the forward position 32, the bowstring 11 to the rest position 37 and propel the arrow 1 with kinetic energy substantially equal to the stored potential energy in the first and second resilient spring portions 22, 22*a* of the bow 10.

The curve y shown in FIG. 8 is a curve which resulted from the adjustment of the adjusting bolts 59, 59*a* to give a low peak value for the draw force FB or stated in another way, a bow 10 with less poundage. The curves x and y are essentially the same except that peak 71 of curve y is less than peak 70 of curve x. The draw force let-off as shown by curve portion 72 of the curve x is also similar to the draw force let-off shown by curve portion 73 of curve y. This feature of the adjusting bolts 59, 59*a* provides for the enjoyment of the same bow 10 for target practice or hunting, since the poundage of the bow 10 may be changed easily.

Having thus described the invention, it will be evident that other modifications and improvements may be made by one skilled in the art which would come within the scope of the annexed claims.

What is claimed as new and desired to be secured by Letters Patent of the United States is:

1. An improved archery bow comprising:

(a) a handle, (b) first and second similar articulate resilient bow limbs extending outwardly from said handle, (i) said first articulate resilient bow limb being jointed at a first pivotal joint between a first resilient spring portion and a first bow tip-portion, (ii) said second articulate resilient bow limb being jointed at second pivotal joint between a second resilient spring portion and a second bow tip-portion, (iii) said first and second bow tip-portions having first and second bow tips respectively shiftable through forward and rearward positions and a neutral position therebetween, (c) a bowstring connected between said first and second bow tips, (d) tandon means including a first tendon cable connected between said first bow tip and said second resilient spring portion and a second tendon cable connected between said second bow tip and said resilient spring portion for yieldingly spring biasing said bowstring and said first and second bow tips in said forward position, (e) said bowstring having a necking point for applying a rearwardly acting draw force thereto of an increasing magnitude to shift said first and second bow tips from said forward position to said neutral position and of a decreasing magnitude to shift said first and second bow tips from said neutral position to said rearward position thereby manifesting a draw force let-off at said nocking point of said bowstring when said first and second bow tips shift from said neutral position to said rearward position, (i) said first and second resilient spring portions of said first and second bow limbs flex in response to shifting of said first and second bow tips of said first and second articulate bow limbs, and (f) roller means including a first roller mounted on said first resilient spring portion of said first bow limb in cooperative relationship with said first tendon cable of said tendon means and said first bow tip of said first bow limb and a second roller mounted on said second resilient portion of said second bow limb in cooperative relationship with said second tendon cable of said tendon means and said second tip of said second bow limb for continuous flexure of said first and second resilient spring portions of said first and second bow limbs during shifting of said first and second bow tips between said forward and rearward positions.

2. An archery bow according to claim 1 wherein said first and second resilient spring portions of said first and second articulate bow limbs being arcuated and said first and second bow tip-portions being recurved with respect to said first and second resilient spring portions of said first and second articulate bow limbs.

3. An archery bow according to claim 1 wherein said first roller of said roller means being disposed proximal to said first pivotal joint of said first bow limb and said second roller of said roller means being disposed proximal to said second pivotal joint of said second bow limb.

4. The invention according to claim 1 wherein said first and second rollers each include guide grooves for guiding therein said first and second tendon cables respectively.

5. An improved archery bow comprising:

(a) a handle, (b) first and second similar articulate resilient bow limbs extending outwardly from said handle, (i) said first articulate resilient bow limb being jointed at a first pivotal joint between a first energy storing resilient spring portion and a first bow tip-portion, (ii) said second articulate resilient bow limb being jointed at a second pivotal joint between a second energy storing resilient spring portion and a second bow tip-portion, (iii) said first and second bow tip-portions having first and second bow tips respectively shiftable through forward and rearward positions about said first and second pivotal joints respectively and a neutral position therebetween, (c) tendon means including a first tendon cable connected between said first bow tip and said second resilient spring portion and a second tendon cable connected between said second bow tip and said first resilient spring portion for yieldingly spring biasing said first and second bow tips in said forward position, (d) a bowstring connected between said first and second bow tips, (i) said bowstring being disposed diametrically opposite to said first and second tendon cables of said tendon means at said first and second bow tips respectively for communicating energy to and from said first and second energy storing resilient spring portions of said first and second articulate limbs in response to shifting of said first and second bow tips, (ii) said bowstring having a nocking point for applying a rearwardly acting draw force thereto of an increaing magnitude to shift said first and second bow tips from said forward position to said neutral position and of a decreasing magnitude to shift said first and second bow tips from said neutral position to said rearward position thereby manifesting a draw force let-off at said nocking point of said bowstring when said first and second bow tips shift from said neutral position to said rearward position, and (e) roller means including a first roller mounted on said first resilient spring portion of said first bow limb in cooperative relationship with said first bow tip and coacting with said first tendon cable and a second roller mounted on said second resilient spring portion of said second bow limb in cooperative relationship with said second bow tip and coacting with said second tendon cable for flexing said first and second resilient spring portions in response to the shifting of said first and second bow tips about said first and second joints of said first and second bow limbs respectively between said forward and rearward positions of said first and second bow tips.

6. The invention defined in claim 5 wherein said first and second energy storing resilient spring portions are arcuate and said first and second bow tip-portions are recurved with respect to said first and second spring portions of said first and second articulate bow limbs.

7. An archery bow comprising:

(a) a handle, (b) first and second similar articulate resilient bow limbs extending outwardly from said handle, (i) said first articulate resilient bow limb being jointed at a first pivotal joint between a first energy storing resilient spring portion and a first bow tip-portion, (ii) said second articulate resilient bow limb being jointed at a second pivotal joint between a second energy storing resilient spring portion and a second bow tip-portion, (iii) said first and second bow tip-portions having first and second bow tips respectively each being shiftable forwardly to a forward position and rearwardly to a rearward position and a neutral position therebetween with respect to said first and second pivotal joints, (c) a bowstring connected between said first and second bow tips, (i) said bowstring having a nocking point for applying thereto a rearwardly acting draw force to shift said first and second bow tips rearwardly to said rearward position and to draw said bowstring from a rest position to a drawn position, (d) tendon means coacting with said first and second spring portions and coupled diametrically opposed to said first and second bow tips for yieldingly urging said first and second bow tips forwardly to said forward position and said bowstring to said rest position by a spring force counteracting against said draw force at said bow tips whereby a part of said spring force is directed forwardly to said first and second pivotal joints through said first and second bow tip-portions when said first and second bow tips shift rearwardly from said neutral position to said rearward position and the remaining part of said spring force counteracts against said draw force, (i) said tendon means includes a first tendon cable connected between said first bow tip of said first articulate bow limb and said second resilient spring portion of said second articulate bow limb and a second tendon cable connected between said second bow tip of said second articulate bow limb and said first resilient spring portion of said first articulate bow limb, and (e) roller means having a first roller mounted on said first resilient spring portion and coacting with said first tendon cable and a second roller mounted on said second resilient spring portion and coacting with said second tendon cable for flexing said first and second energy storing resilient spring portions of said first and second articulate bow limbs throughout shifting of said first and second bow tips.

* * * * *